US007905070B2

(12) United States Patent
August

(10) Patent No.: US 7,905,070 B2
(45) Date of Patent: Mar. 15, 2011

(54) INTERLOCKING MORTARLESS STRUCTURAL CONCRETE BLOCK BUILDING SYSTEM

(76) Inventor: John August, Volcano, HI (US)

( * ) Notice: Subject to any disclaimer, the term of this patent is extended or adjusted under 35 U.S.C. 154(b) by 567 days.

(21) Appl. No.: 11/611,767

(22) Filed: Dec. 15, 2006

(65) Prior Publication Data

US 2007/0151191 A1 Jul. 5, 2007

Related U.S. Application Data

(60) Provisional application No. 60/752,557, filed on Dec. 21, 2005.

(51) Int. Cl.
*E04C 1/00* (2006.01)
*E04C 1/40* (2006.01)

(52) U.S. Cl. ..... 52/604; 52/600; 52/606; 52/610

(58) Field of Classification Search ..... 52/600, 52/604, 606, 607, 610
See application file for complete search history.

(56) References Cited

U.S. PATENT DOCUMENTS

| | | | | | |
|---|---|---|---|---|---|
| 2,736,188 | A * | 2/1956 | Wilhelm | 52/560 |
| 3,717,967 | A * | 2/1973 | Wood | 52/259 |
| 4,075,808 | A * | 2/1978 | Pearlman | 52/439 |
| 4,098,040 | A * | 7/1978 | Riefler | 52/223.7 |
| 4,372,091 | A * | 2/1983 | Brown et al. | 52/592.6 |
| 4,473,985 | A * | 10/1984 | Hunt | 52/592.6 |
| 4,866,891 | A * | 9/1989 | Young | 52/105 |
| 5,086,600 | A | 2/1992 | Holland et al. | |
| 5,315,802 | A * | 5/1994 | Hart | 52/607 |
| 5,379,565 | A * | 1/1995 | Vienne | 52/606 |
| 5,485,703 | A * | 1/1996 | Nordahl | 52/562 |
| 5,575,128 | A * | 11/1996 | Haener | 52/572 |
| 5,685,119 | A * | 11/1997 | Zschoppe | 52/592.5 |
| 5,701,710 | A * | 12/1997 | Tremelling | 52/426 |
| 5,802,797 | A * | 9/1998 | Storer-Folt | 52/604 |
| 5,899,040 | A * | 5/1999 | Cerrato | 52/604 |
| 5,901,520 | A * | 5/1999 | Abdul-Baki | 52/592.6 |
| 5,921,046 | A * | 7/1999 | Hammond, Jr. | 52/564 |
| 6,010,279 | A * | 1/2000 | Taylor-Smith | 405/286 |
| 6,065,265 | A * | 5/2000 | Stenekes | 52/607 |
| 6,195,946 | B1 * | 3/2001 | Lott et al. | 52/100 |
| 6,226,951 | B1 * | 5/2001 | Azar | 52/604 |
| 6,244,009 | B1 * | 6/2001 | Cerrato | 52/604 |
| 6,253,519 | B1 * | 7/2001 | Daniel | 52/591.1 |
| 6,305,142 | B1 * | 10/2001 | Brisson et al. | 52/742.14 |
| 6,758,020 | B2 * | 7/2004 | Cerrato | 52/606 |
| 6,907,704 | B2 | 6/2005 | Abang Ali et al. | |
| 2005/0204663 | A1 * | 9/2005 | Ferguson | 52/270 |

* cited by examiner

*Primary Examiner* — Dalena Tran
*Assistant Examiner* — Jason Holloway
(74) *Attorney, Agent, or Firm* — Seed IP Law Group PLLC

(57) ABSTRACT

An interlocking modular building block system for mortarless cavity wall construction having blocks configured such that upon grouting, the cavity is solidly filled in a unified mass. Four block configurations are provided, namely runner, half, corner, and end block units. The runner has a length two times its width, and the other blocks have the same width and length as the width of the runner. Common to all blocks is a pair of parallel offset solid walls forming the outside and inside walls while creating vertical and horizontal positive and negative alignment features. The offset walls also form flat horizontal and vertical surfaces where successive units meet upon alignment. These walls are connected by one or more transverse membranes, with the exception of the corner block, where the walls are joined end to end at right angles.

18 Claims, 13 Drawing Sheets

INTERLOCKING MORTARLESS STRUCTURAL CONCRETE BLOCK BUILDING SYSTEM

BACKGROUND OF THE INVENTION

1. Field of the Invention

This invention relates to construction materials and, more particularly, to an improved type of interlocking mortarless structural concrete building block system.

2. Description of the Related Art

The origin of the common concrete block in use today was meant as a component to compliment the prior primary masonry building unit, the common clay fired brick. The larger size of the concrete block created greater installation economy over brick and eventually dominated the building industry.

Concrete blocks are also referred to as concrete masonry units or cmus. The majority of these blocks are produced by hydraulic press machinery and vibrated under pressure in steel molds. The final product is usually heavy and rough in texture. While most concrete block usually have vertical cellular cores, the majority of these cores are non-communicative horizontally. The open cells within a wall of this type are filled with additional flowable concrete known as grout. Depending on the type of block system or engineering requirements, there is great variety on the location of grouted cells in any solid masonry wall. Concrete block are intended to emulate the functionality and strength of a poured-in-place reinforced concrete wall, which has greater strength to thickness ratio.

As most concrete block applications are attempts to create a solid uniform concrete mass, such as poured-in-place concrete, the relative performance of a cmu structure should match the inherent strength potential of a monolithically poured concrete wall. Conventional wisdom makes up for this discrepancy by simply creating thicker cmu walls to overcome their inherent engineering weaknesses over poured-in-place walls.

Concrete block suffers from any number of performance deficiencies, yet still constitute a standard in the concrete building industry. From a production standpoint, the manufacture of these types of blocks is economical; however, their actual performance is marginal. While there have been many attempts to overcome inherent deficiencies, there still exist a number of problems that create disadvantages:

a) Common to most concrete blocks is a size and weight that makes placement cumbersome. The functional elements are limited by a dense concrete shell, which severely restricts communication from core to core and which adds unnecessary weight while serving marginal functionality.

b) The majority of these cells are usually vertical, although some cells have provision for horizontal channels. There is little horizontal cohesion in a wall of this nature except what is achieved by lateral reinforcement bars.

c) Between each block is laid a horizontal bed of mortar, the bed joint, and a vertical line of mortar, the head joint. The blocks essentially remain separate, even after their cavities are filled by grouting. The bed and head joints do little for structural integrity, merely adding a heavy mass of mortar to glue the separate cmus. The result is a substantial amount of nonfunctioning mass verses overall intended functionality, or structural deficiency. This is demonstrated by the number of uncommunicated cells that characterize this type of system. Walls of this type have a tendency to fail exactly on joint lines. Mortared joints do little for overall structural integrity as compared with an integral monolithic mass of concrete.

d) Conventional block are labor intensive, somewhat technical, and restrictive to specific labor and strength requirements. Unskilled labor is often deterred from their use due to these reasons. The process is also slow, even for a skilled mason, due to both the size and weight of the blocks and the time consumed in mortaring every joint and aligning and leveling each unit.

e) While attempts have been made in alignment with mortarless systems, either of concrete or plastic cmus, another problem has been creating systems with tolerances too tight to accommodate minor fluctuations that can occur in a foundation or wall layout, and as result, modification of these cmus on site can be laborious, frustrating, and time consuming.

f) Every conventional block must precisely float on a bed of mortar, which requires constant use of leveling devices. This requires additional installation time.

g) Conventional block, due to their limited cellular structure, make the placement of horizontal reinforcement bars or other transit tubes restrictive. To overcome this, many block systems have portions of the block that can be knocked out, but this is another labor step and wasteful of material. These types of block depend solely on reinforcement for horizontal tensile strength, since there is usually little horizontal communication between the blocks for the filling concrete to either pass or reside. Instead are a series of mortar/concrete interfaces with no common singularity or monolithic mass.

h) Many of the plastic systems provide little structural integrity and rely totally on the concrete grout fill for anything structural. These types of systems also require subsequent coatings to seal the plastic from air and moisture penetration.

BRIEF SUMMARY OF THE INVENTION

The disclosed embodiments of the present invention provide a mortarless, open-celled cavity concrete wall building block system, which when grouted with concrete, interlocks all individual block units into a singular monolithic concrete mass. The disclosed embodiments provide greater efficiency, not only in functional mass, but also speed of installation. It can be utilized by semi-skilled labor. Performance is enhanced from an engineering standpoint as demonstrated when assembled in a structural configuration. The created integral spaces together function as a single monolithic open cavity for solid concrete grout fill both laterally and vertically. It is designed to be simpler, swifter, and stronger than other block systems, whether they be of concrete or plastic.

The embodiments of the invention disclosed herein are directed to:

a) A simple system of four basic parts, which upon assembly using a plurality of shapes and forms, any number of practical structural configurations can be constructed easily by semi skilled labor.

b) A solid grouted system designed as a shell structure with minimal transverse membranes to allow for the maximum amount of concrete fill per total wall volume.

c) A single concrete mass serving the dual function of cavity fill and grouting all the vertical and horizontal joints of each block to create a monolithic mass with a high degree of structural integrity.

d) Vertical and horizontal protrusions and recesses which provide alignment elements and serve the dual purpose of creating maximum surface area for grouting purposes.

e) Integrated cellular core structure both horizontally and vertically. Each individual unit is either a complete cell or a partial cell, which when matched with a complimentary adjacent unit, the interfacing planes form a completed cell.

f) Blocks that can be set without mortar, but instead glued in place with any number of construction adhesives such as epoxy formulated for concrete. The purpose of this aspect is to supply enough transverse shear to offset the hydrostatic pressure of wet concrete and prevent accidental displacement before grouting. It may or not be a structural bond, as it is the grout itself which interlocks the block.

g) A system designed to work in conjunction with cellular or other high slump concretes by providing an open cavity wall with a maximum block surface, minimal transverse membranes, and solid grouted concrete interface.

In accordance with one embodiment of the invention, a structural block is provided that includes at least two walls joined together to form a single, coplanar wall. Each coplanar wall has a pair of parallel offset walls formed of an inside wall and an outside wall. Ideally, two coplanar walls are joined together at one end to form a corner unit or are connected by one or more transverse members, such as an end wall to form an end unit or by an interior membrane to form a standard runner block.

In accordance with another aspect of the foregoing embodiment, each wall is formed of an interior wall and an exterior wall that define interlocking features for cooperation with adjacent structural members.

In accordance with another embodiment of the invention, a structural block system is provided that includes a plurality of blocks, each block having at least one pair of walls joined together, each wall of the pair of walls comprising a pair of offset walls formed of an inside wall and an outside wall. Ideally, the features described above with respect to the structural block are incorporated within the blocks of the foregoing system.

In accordance with another aspect of the foregoing embodiment, transverse members cooperate with the walls of each block such that when the blocks are placed together cavities are defined that can be filled with grout. Ideally, the interlocking features of each block cooperate to define a grout space that can likewise be filled with grout for greater strength.

In accordance with another embodiment of the invention, a block is provided that includes at least two sidewalls having a protrusion extending from an end of the sidewall, the protrusion defining a shoulder on the end of the sidewall, and the protrusion having a face with a portion of the face comprising a beveled surface. Ideally the protrusion extends from a longitudinal end or a vertical end or both a longitudinal end and vertical end of the sidewall.

In accordance with another aspect of the foregoing embodiment, the sidewall has an interior face and an exterior face, and the protrusion extends along the exterior face and the shoulder forms a recess on the interior face, and the beveled surface is formed on an interior face of the protrusion.

In accordance with a further aspect of the disclosure, an interlocking mortarless structural concrete block building system is provided that includes a plurality of runner blocks, each runner block comprising a pair of sidewalls, each sidewall comprising an outside wall portion and an inside wall portion dimensioned smaller than the outside wall portion such that the outside wall portion extends beyond the inside wall portion to form protrusions, and the inside wall portion forms recesses, each runner block placed in abutting relationship with other runner blocks so that the protrusions and recesses of adjacent abutting runner blocks form first internal cavities, and at least one transverse member extending to each inside wall and cooperating with the at least one transverse member of adjacent runner blocks to form second internal cavities; at least one of an end block and a corner block placed in abutting relationship with at least one of the plurality of runner blocks; and a fill material in the first and second internal cavities.

In accordance with further aspects of the disclosure, the outside wall portion extends beyond the inside wall portion in all directions, and each runner block can include a beveled face formed between each protrusion and each recess. Each beveled face is preferably formed on an interior face of each protrusion, and the beveled faces cooperate with the protrusions and recesses to form a cellular structure that comprises the internal cavities. The system can include two transverse members in each runner block that form a single cell between them and a half cell on another side of each transverse member.

Further advantages include a new modulus size based on a standard other than the common brick which can either be English or Metric equivalent and be approximately the same in measurement and standardization, thus creating a more universally versatile and easier handled cmu. Another improvement is a cmu having a smoother surface, which makes it both easier to handle and to enhance the application of subsequent coatings, such as paint. Another aspect is creation of more user friendly cmus, which extends construction parameters to those with no specific prior skills.

BRIEF DESCRIPTION OF THE SEVERAL VIEWS OF THE DRAWINGS

The foregoing and other features of the present invention will be more readily appreciated as the same become better understood from the following detailed description when taken in conjunction with the accompanying drawings, where related figures utilize common reference numbers with different alphabetical suffixes, wherein.

DETAILED DESCRIPTION OF THE INVENTION

Figure 1A:
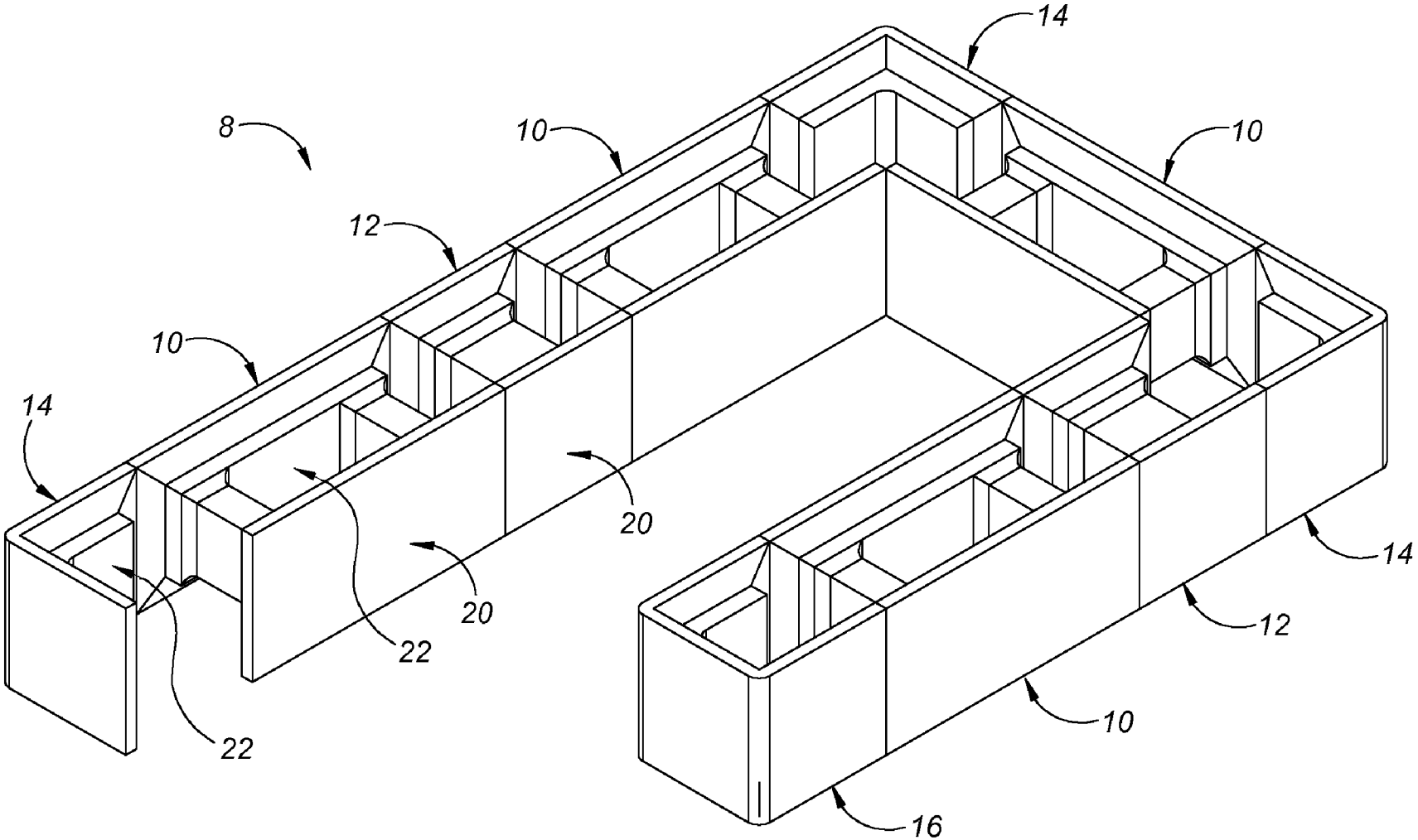
FIGS. 1A-1B are isometric and top views, respectively, of a modular block system and components formed in accordance with the present invention.
Figure 1B:
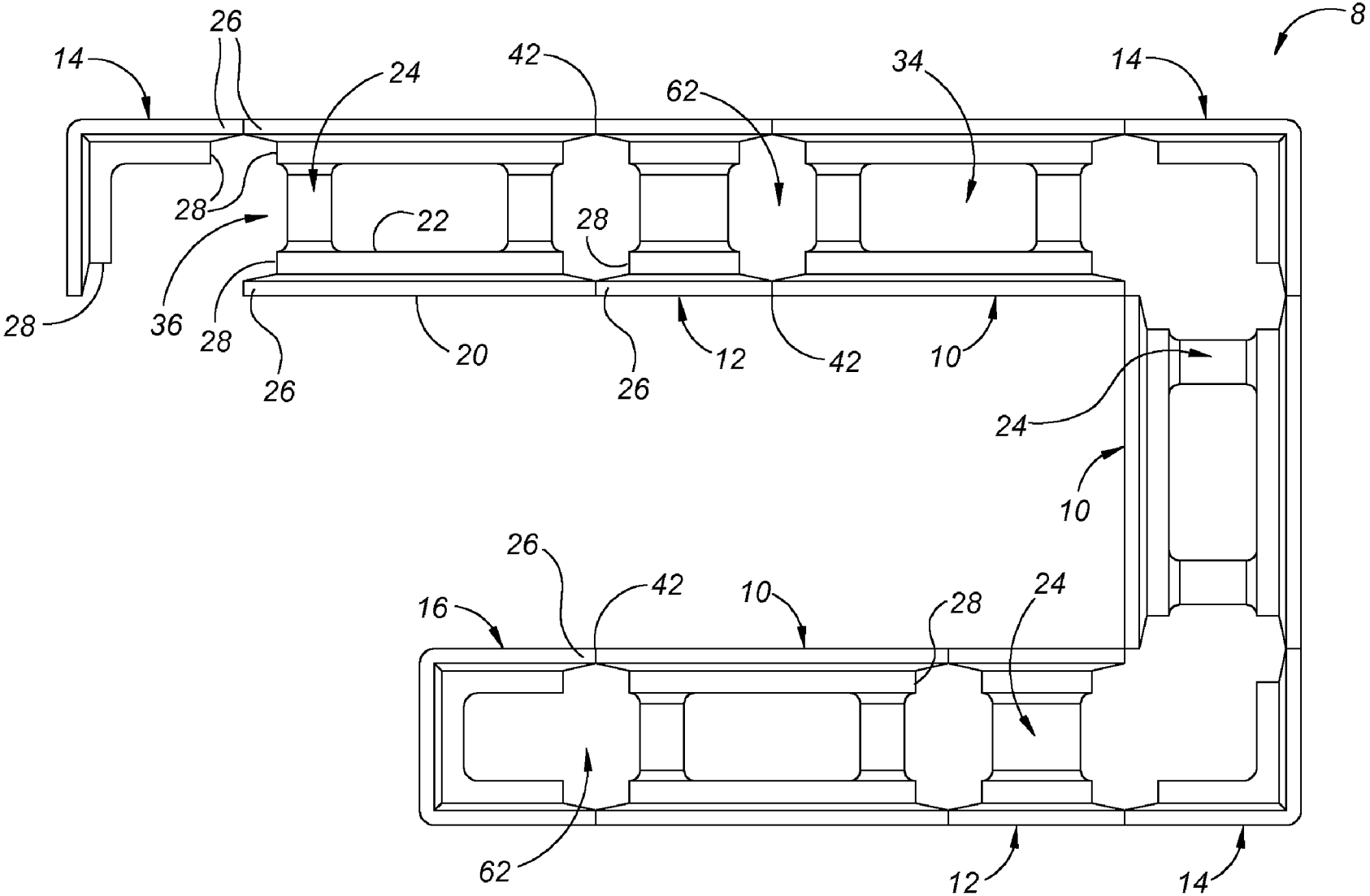

A representative embodiment of an interlocking mortarless structural concrete block building system 8 is illustrated in FIGS. 1A-1B. A basic block layout encompassing straight walls, corners, and ends is shown in perspective in FIG. 1A and the same layout is shown in a top view in FIG. 1B. The system 8 is designed for assembly in which a plurality of blocks 10 are stacked in successive horizontal courses in a staggered relationship using four different block configurations. The basic repetitive unit, the runner block 10, has a length twice as long as it is wide. A half block 12 is the same width and half the length as the runner block 10. The corner block 14 has two adjacent walls of the same width as the half block. The end block 16 consists of three adjacent walls all of the same width as the runner block 10. Additional embodiments are shown in FIGS. 2, 3, 4, and 5 illustrating various units within the system. FIG. 6 shows the system 8 in use which is described in more detail hereinbelow.

Figure 6A:
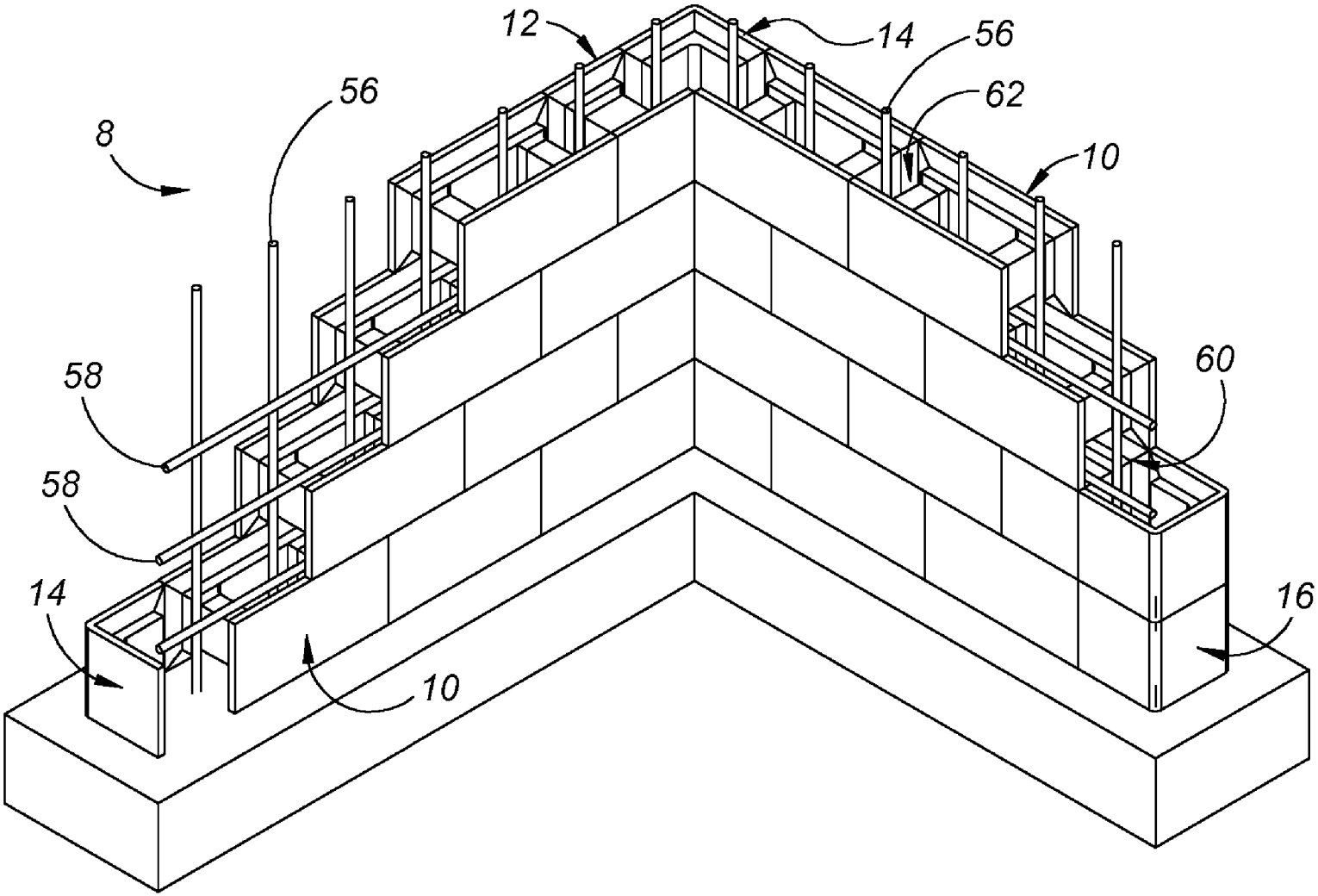
FIG. 6A is an isometric view showing a plurality of blocks when additional horizontal courses are aligned in a structural manner in accordance with the present invention.
Figure 6B:
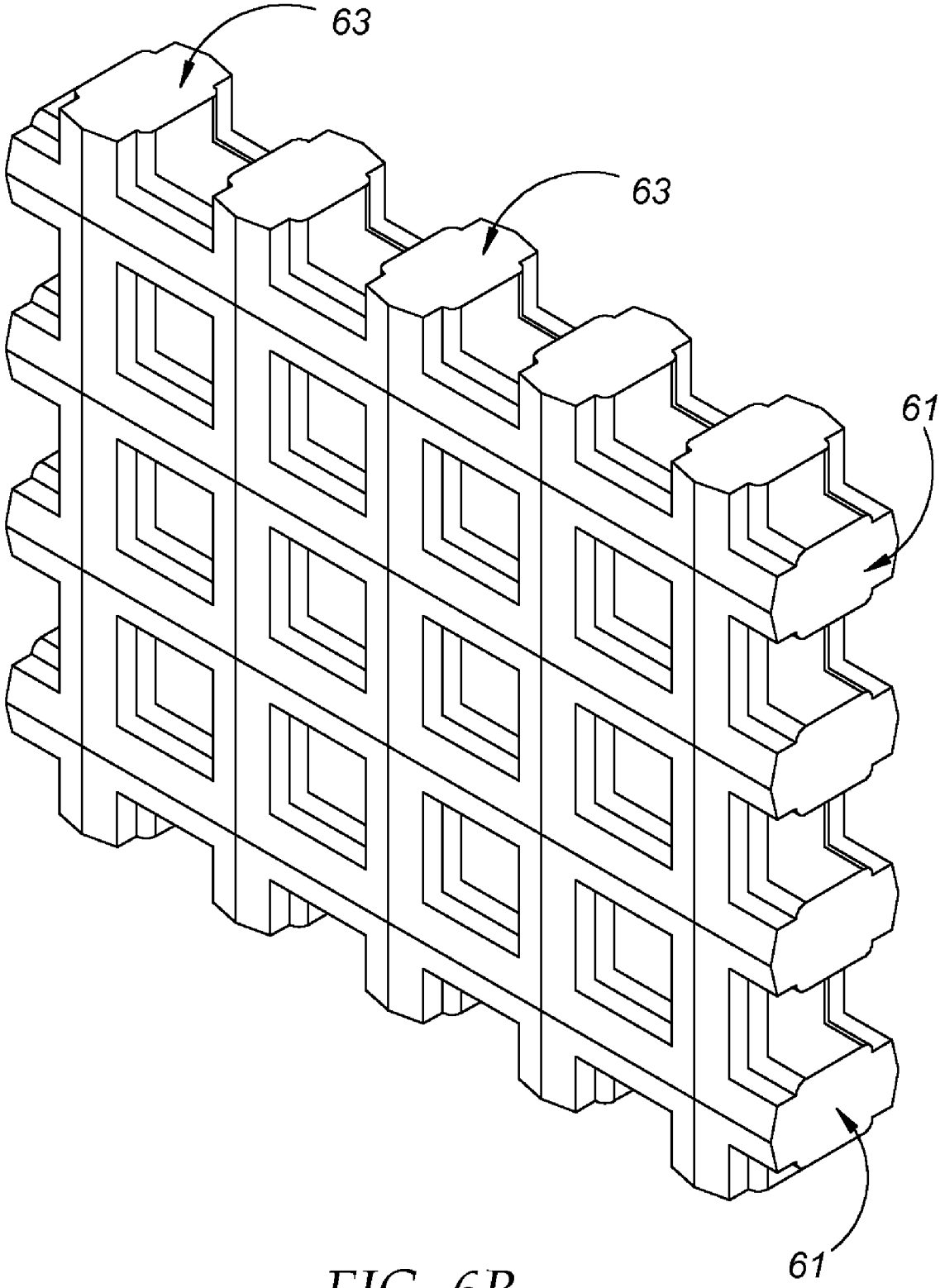
FIG. 6B is an isometric view showing the resulting repetitive concrete core structure of system 8 after the blocks are filled with concrete in accordance with the present invention.
Figure 6C:
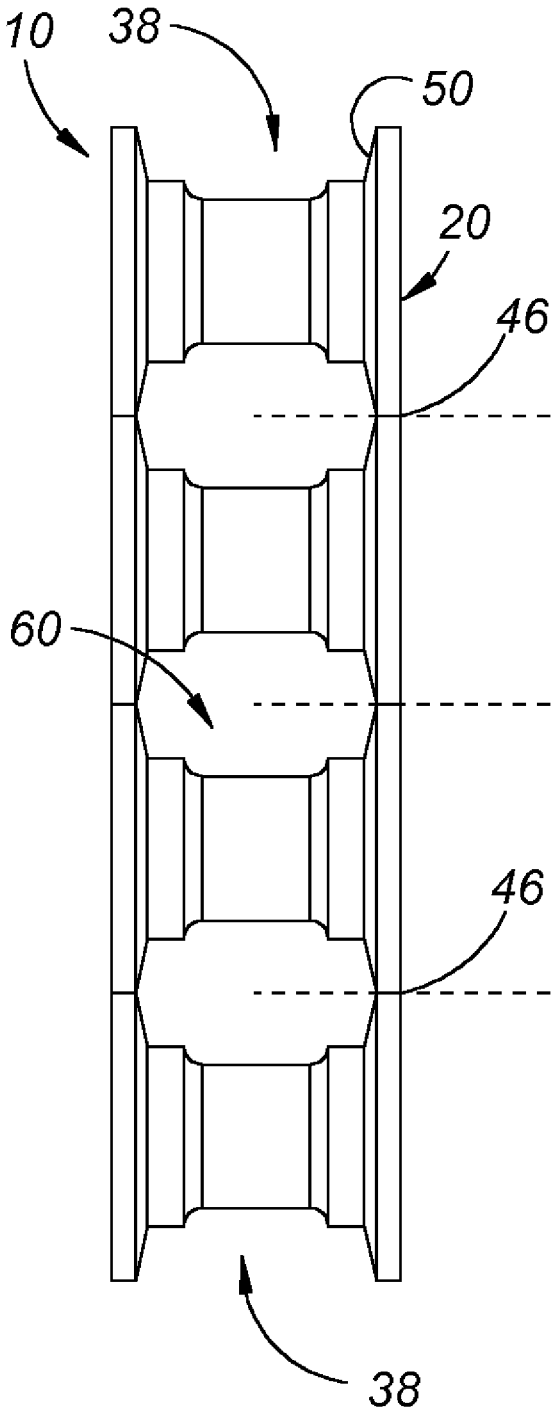
FIGS. 6C-6D are end views of a multiple vertical course with grout fill and reinforcement formed in accordance with the system of the present invention.
Figure 6D:
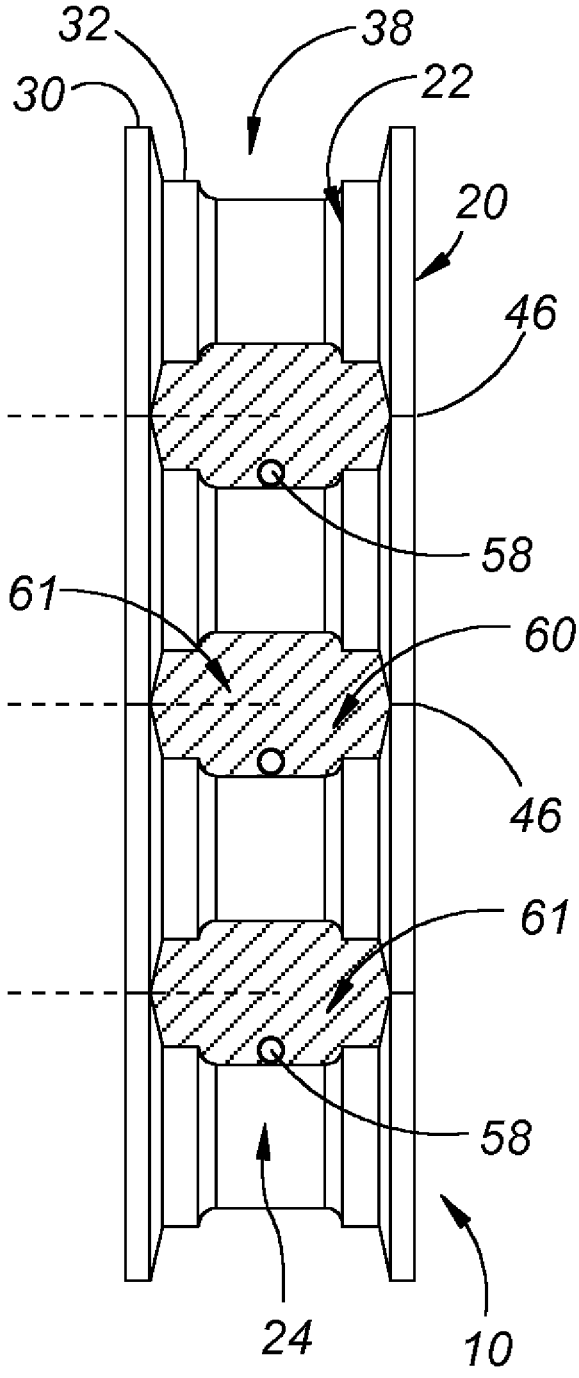
Figure 6E:
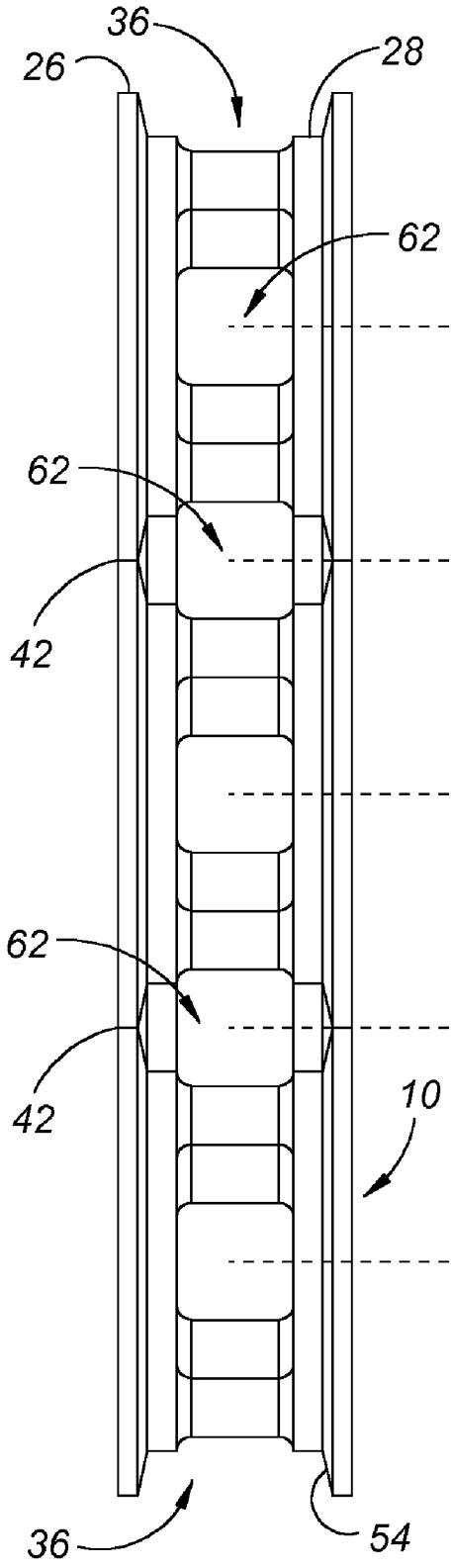
FIGS. 6E-6F are top views of stacked horizontal courses and modular grout core structures formed in accordance with the system of the present invention.
Figure 6F:
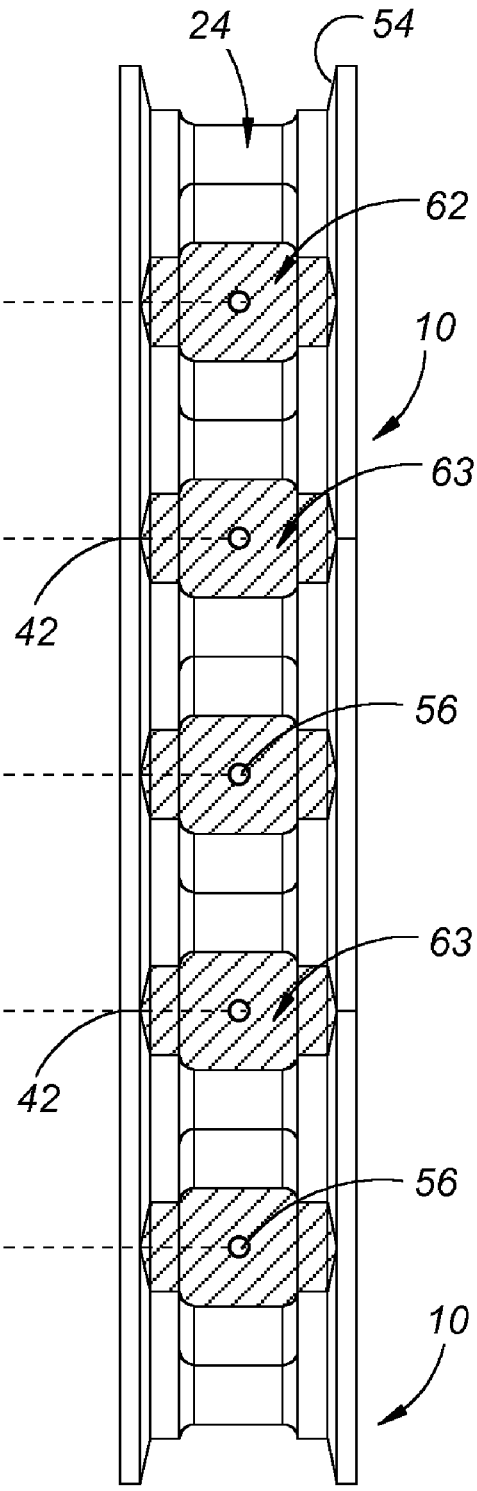

The runner and half blocks 10, 12, each have a pair of offset walls 20, 22 with each wall 20, 22 having parallel faces, one on the outside, and the other on the inside. The corner block 14 consists of two adjacent offset coplanar walls 20, 22 with offset parallel faces. The end block 16 has three offset walls 20, 22 with offset parallel faces. The walls 20, 22 are joined at right angles to one another to create an open end u-shape configuration. Ideally, the walls 20, 22 are solid, although other known internal structures may be used, such as an amorphous material. One aspect of these offset walls 20, 22 is to create longitudinal protrusions 26 and longitudinal recesses 28 on both ends that align with their complimentary configuration when successive blocks are placed together as shown in FIG. 1B. A transverse membrane 24 connects opposite walls 20, 22 in the runner and half blocks 10, 12. Another aspect of the membrane 24 shown in FIG. 1B is creation of cellular structures 34, 36 within the cavity walls 20, 22, which can either be a whole cell 34 or any number of half-cell 36 configurations. When matched with another half-cell 36, the two half-cells 36 become completed vertical grout cells 62, as seen in FIGS. 1B, 6B, and 6F.

The overall modulus of the system 8 is based on a fractional equivalent of the whole by a division base of 4 relative to the length of runner block 10 as shown in FIG. 1B. Thus, the basic repetitive runner block 10 has a width ¾ length. The whole cell structure 34 is configured such that each are ¾ of the total length of the runner block 10; and the half-cell 36, when combined with another cell 36, is ¼ of the total length of the runner block 10. The height of individual units can be in any reasonable multiple of 0.25 of the runner block 10 length. It is this unique relationship that creates a uniform minimum vertical cellular dimension of ¼ of the length of the block 10 when successive horizontal courses are stacked in a vertical fashion, as seen in FIGS. 6C and 6D. The verticular cellular structure is uniform and repetitive throughout, as seen in FIGS. 1B, 6B, and 6F.

There are various possibilities for horizontal assembly of the block system 8 based on the identical protrusions 26 as seen in FIG. 1B. The upper left corner block 14 mates one of its two protrusions 26 with a corresponding protrusion from the back end of the runner block 10. The front end of the runner block 10 mates its protrusions 26 with the protrusions 26 of the half block 12 and so on. The protrusions 26 function mainly as alignment guides during installation, while another aspect is providing interlocking structural grout joints when the cell is filled with concrete grout as shown in FIGS. 6B and 6D.

Figure 2A:
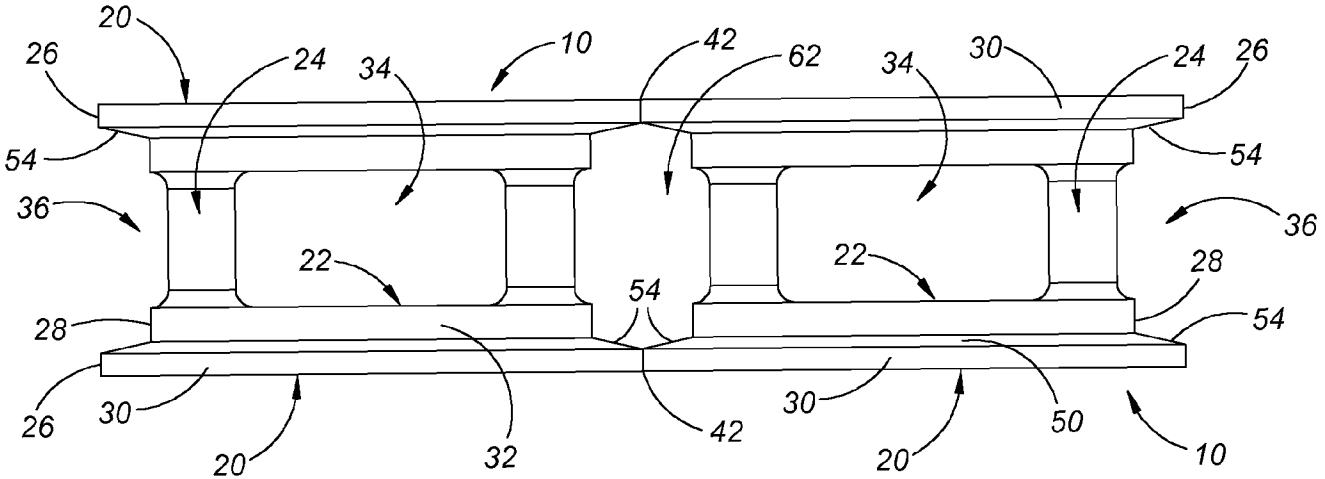
FIGS. 2A-2E are a top view, end view, side view, isometric view, and end view of several block stacked in a vertical array, respectively, formed in accordance with the present invention.

The main operating unit is the basic repetitive runner block 10 shown in detail in FIGS. 2A-2E. The top view in FIG. 2A shows two blocks in an adjacent horizontal position, each having two pair of longitudinal parallel offset walls formed of an outside wall 20 and an inside wall 22. Ideally, the outside wall 20 and inside wall 22 are joined together to form a single coplanar wall. Alternatively, these two walls 20, 22 can be integrally formed as a single wall. Preferably, the two walls 20, 22 are solid, although the invention is not to be limited to solid walls.

One aspect of the offset walls 20, 22 is the formation of a protrusion 26 on each end of the outside wall 20 and a corresponding longitudinal recess 28 as seen in FIG. 2A. Another aspect of the configuration of the walls 20, 22 is a vertical protrusion 30, and a corresponding vertical recess 32 as seen in the end view of FIG. 2B.

The longitudinal protrusions 26 on the outside walls 20 have a beveled inside face 54 such that the thickness of the outside wall 20 tapers longitudinally towards the exposed end thereof. Likewise, the vertical protrusion 30 on the outside walls has a beveled inside face 50 such that the thickness of each wall tapers towards a vertical end thereof.

Figure 2C:
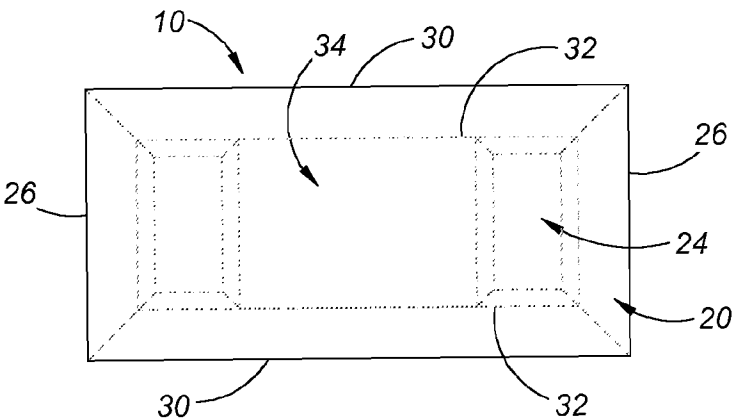
Figure 2B:
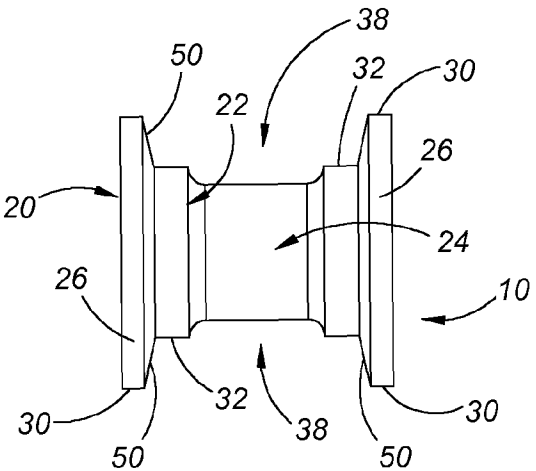
Figure 2E:
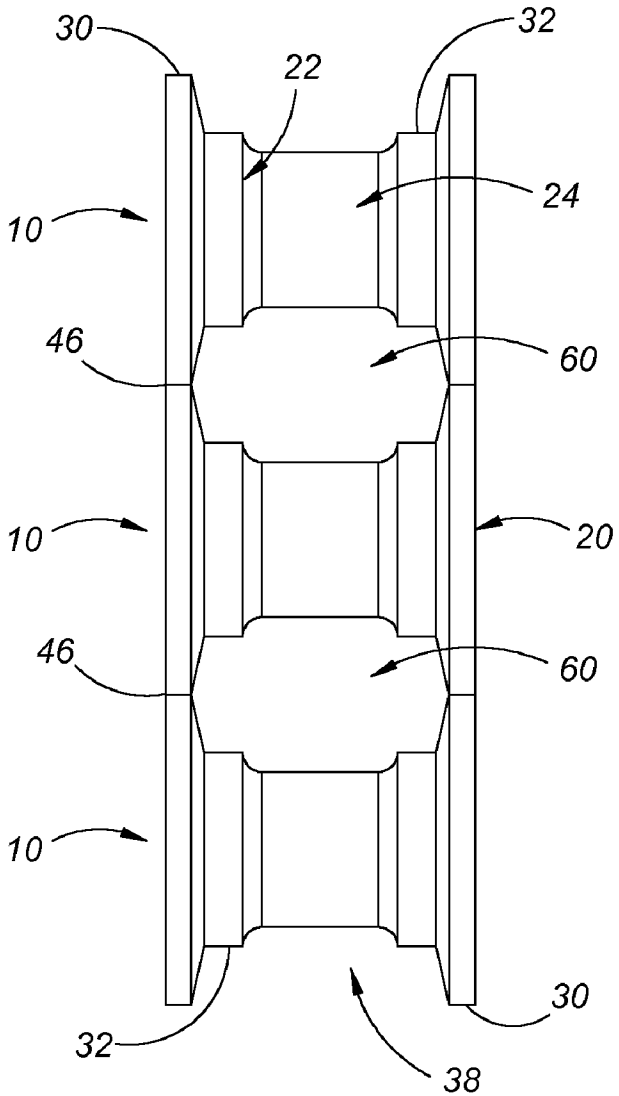

Another aspect of the beveled faces 54, the protrusions 26, and the recesses 28 is the formation of a vertical grout cell 62 seen in FIG. 2A when two units are nested horizontally during installation. The beveled faces 50, protrusions 30, and recesses 32 cooperate in the formation of a horizontal grout cell 60 as seen in FIG. 2E. One aspect of these cells 60, 62 is the creation of space to accommodate grout between adjacent units when the cavity is filled with concrete. Another aspect of these cells 60, 62 is that they provide a means of interlocking adjacent units once the wall is filled with concrete.

Figure 2D:
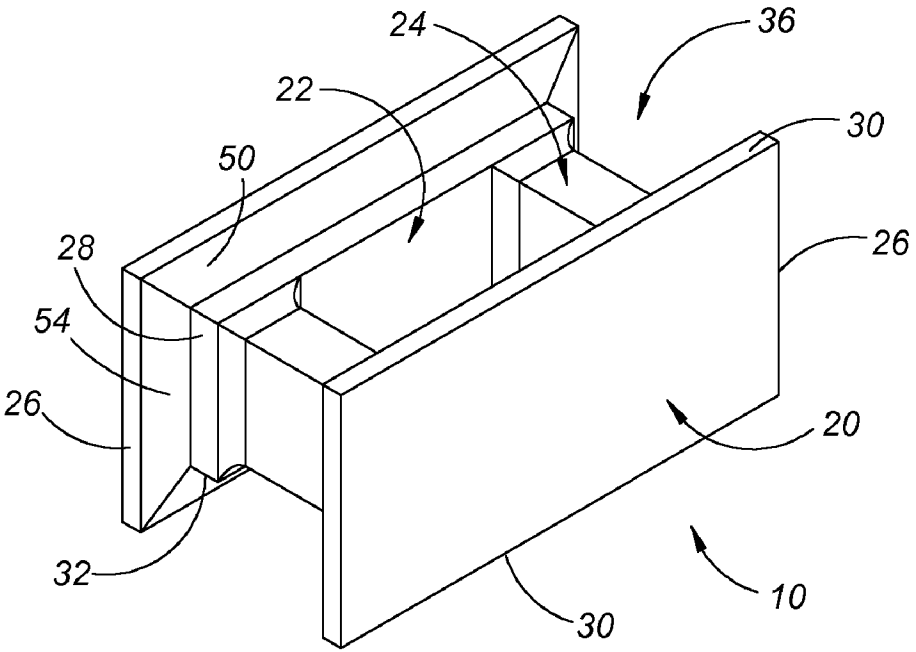

The pairs of parallel coplanar walls 20, 22 are connected by two transverse membranes 24, forming an internal vertical cell cavity 34, and also forming two additional half-cell cavities 36, one at either end, which upon the mating with the next adjacent complimentary end of runner block 10 in a horizontal course, forms a vertical grout cell 62 as seen in FIG. 2A. The membrane 24 forms the structure for a half-cell cavity 38 on both the top and bottom of the block 10, which upon mating with the next vertical course of block 10 set in a horizontal manner forms a horizontal grout cell 60, as seen in FIG. 2E. The longitudinal and vertical protrusions 26, 30 on either end and on the top and bottom of each unit are of sufficient width to allow easy alignment and minimum contact surface area for assembly purposes and frictional stability from one unit to the next to preserve wall integrity until grouting. One aspect of these features is the creation of longitudinal butt joint 42 when two adjacent units are placed together in a horizontal structural manner as seen in FIG. 2A, and likewise the creation of vertical butt joint 46 when successive horizontal courses are stacked in a vertical array as seen in FIG. 2E. Another aspect of these features is to provide a contact surface between adjacent elements for bonding with a thin layer of adhesive to insure stability until the wall is filled solid with concrete. Another aspect of these features is to allow the easy installation of single gang electrical boxes by simple removal of the protrusions 26 and 30. FIG. 2B shows and end view of the runner 10, and the side view in FIG. 2C shows the relative location of the transverse membrane 24 with dashed lines. FIG. 2D shows a perspective and FIG. 2E shows an array of horizontally nested block to show formation of horizontal grout cell 60. The offset mirrored coplanar walls 20, 22 are depicted in a clarified manner.

Figure 3B:
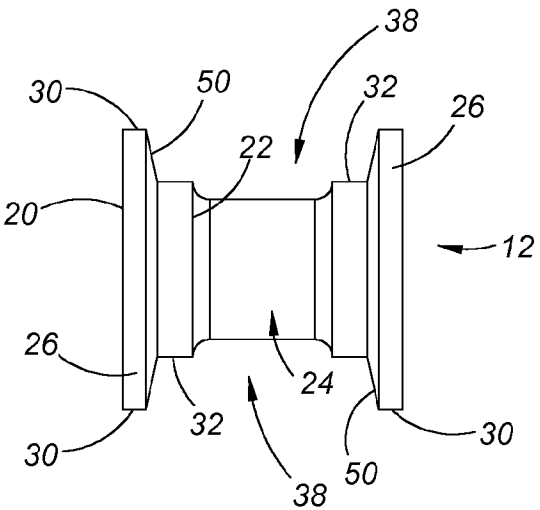
FIGS. 3A-3D are a top view, end view, side view, and isometric view of a half block view, respectively, formed in accordance with the present invention.
Figure 3D:
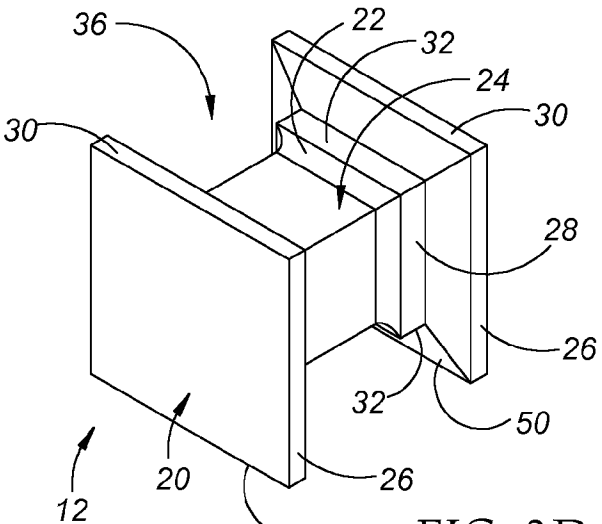
Figure 3A:
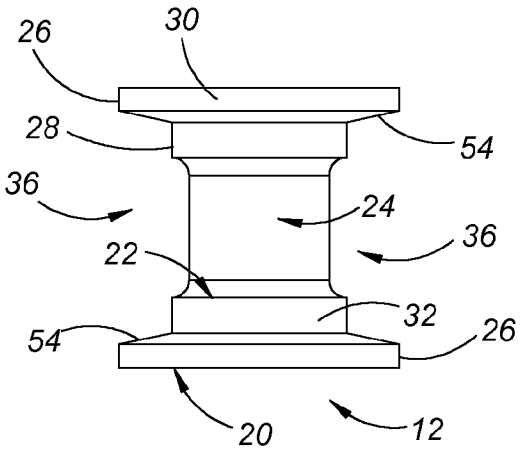

FIG. 3A shows a top view of the half block 12 parallel offset walls 20, 22 connected in the middle by the transverse membrane 24. The block 12 has a total length of ½ of the runner block 10. One aspect of the offset walls 20, 22 is the outside wall 20 is longer than the inside wall 22 to form a longitudinal protrusion 26 with a beveled face 54 on each end of the outside wall 20. A corresponding longitudinal recess 28 is formed on each end of the inside wall 22. The offset walls 20, 22 have a vertical offset that forms a vertical protrusion 30 on the outside wall 20 with a beveled face 50 and a corresponding recess 32. A beveled face 50 is formed on an interior vertical face of each vertical protrusion 30. These beveled faces 50, vertical protrusions 30, and recesses 32 form a horizontal grout cell 60 as seen in FIG. 6C when adjacent units are nested vertically during installation. In addition, the beveled face 54 and recessed face 28 cooperate to form a vertical grout cell 62 as seen in FIG. 6D. The cells 60 and 62 also provides an interlocking means once the cavity is filled with concrete by providing the additional function of extended joint interface between successive units both horizontally and vertically. The coplanar walls 20, 22 are connected with a single transverse membrane 24 forming two additional vertical half-cell cavities 36, one at either end, which upon mating with adjacent complimentary end of next unit in a horizontal course forms a vertical grout cell 62, as seen in FIG. 1B.

Figure 3C:
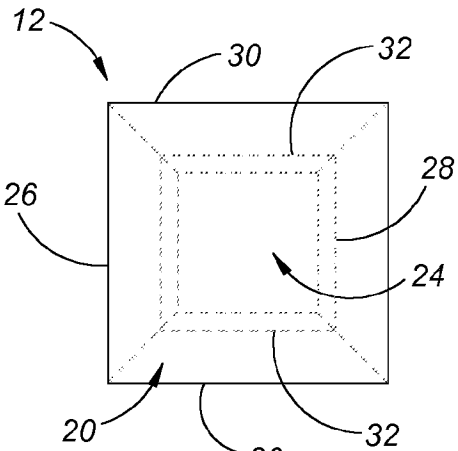

Another aspect of the membrane 24 is forming the structure for a half-cell cavity 38 on both the top and bottom of the half block 12, which upon mating with the next adjacent vertical course of block set in a horizontal manner forms a horizontal grout cell 60, as seen in FIG. 6C. Longitudinal butt joints 42 are thus formed on either end as seen in FIG. 6E and vertical butt joints 46 are formed by adjacent top and bottom units as seen in FIG. 6D. The end view in FIG. 3B shows the transverse membrane 24 connecting inside walls 22 to form top and bottom horizontal half-cell cavities 38. The side view in FIG. 3C shows the location of the transverse membrane 24 and recessed surface 32 in dashed lines. FIG. 3D shows the half block 12 in a perspective view.

Figure 4B:
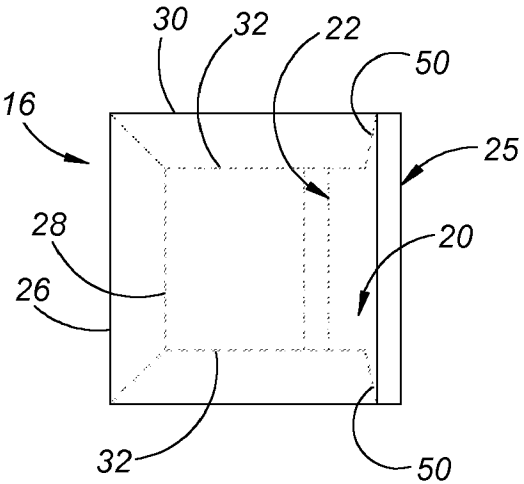
FIGS. 4A-4E are a top view, side view, front isometric view, back isometric view, and bottom isometric view, respectively, of an end block formed in accordance with the present invention.
Figure 4C:
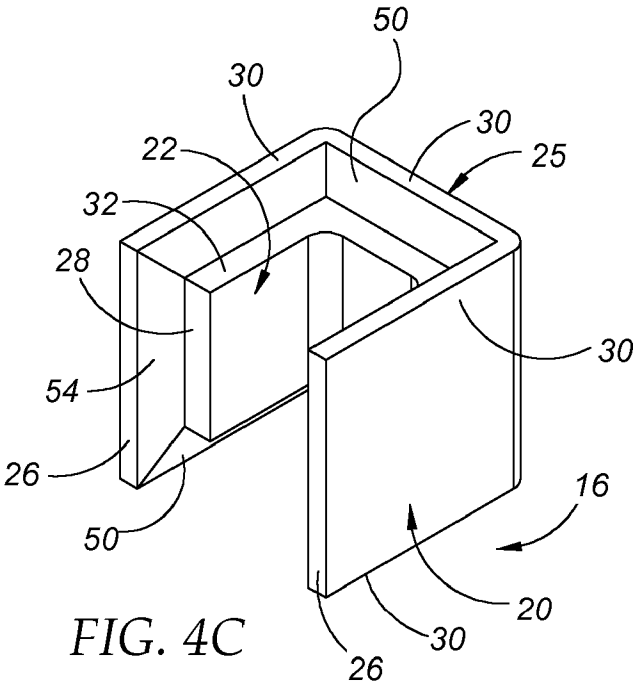
Figure 4A:
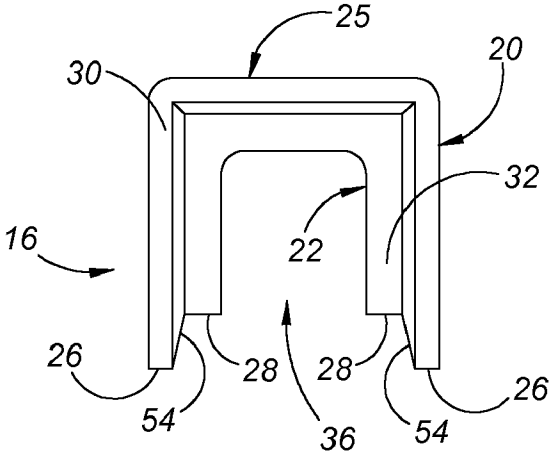
Figure 4E:
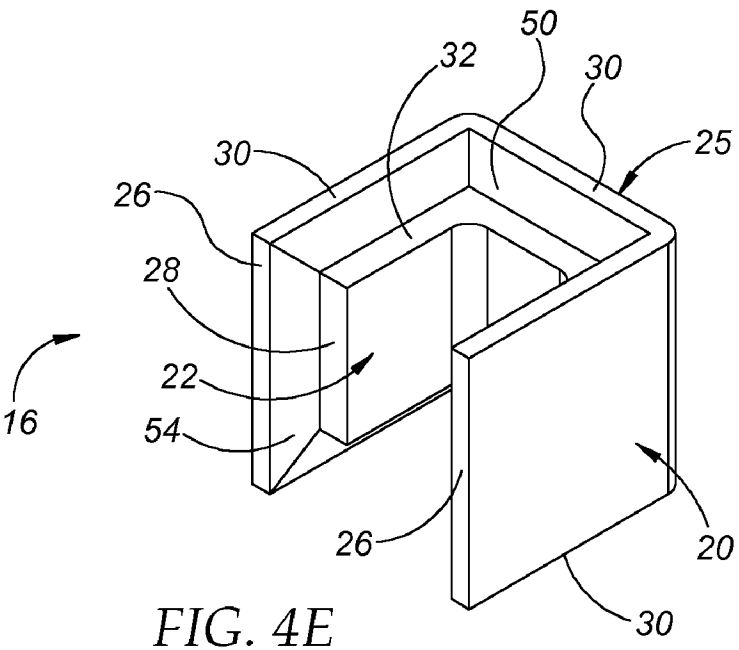
Figure 4D:
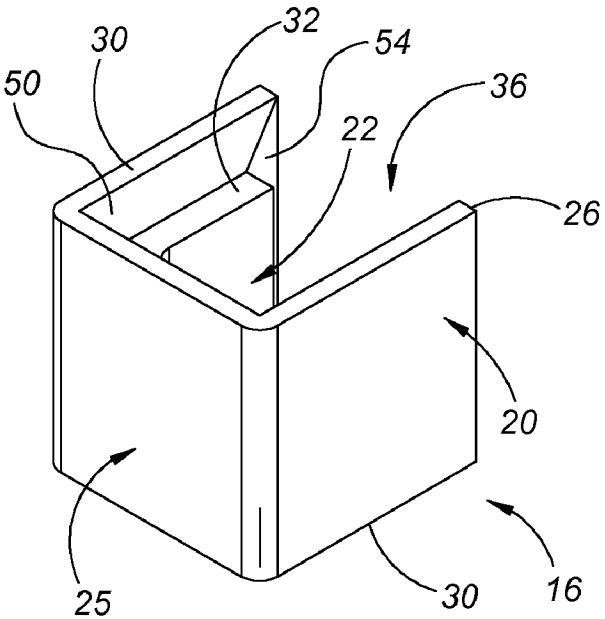

FIG. 4A is a top view of an end block 16, which has the same length as the half block 12. Two parallel offset solid coplanar walls 20, 22 are each transected and joined at one end by a transverse wall 25 having the same configuration as the offset parallel walls 20, 22. The joined walls 20, 22 form a vertical half-cell cavity 36, which upon the mating with a complimentary end of a next block 10, 12, or 16 in a horizontal course forms a vertical grout cell 62, as seen in FIG. 1B. Another aspect of the offset walls 20, 22 is a longitudinal offset that forms a longitudinal protrusion 26 on the outside wall 20 having a beveled face 54, and a corresponding longitudinal recess 28 on the inside wall 22. The outside wall 20 is vertically offset with respect to the inside wall 22 to form a vertical protrusion 30 and complimentary recess 32, as seen in the isometric views of FIGS. 4C, 4D, and 4E. A beveled face 50 as seen in FIGS. 4B, 4C, and 4E is formed on the inside surface of protrusion 30. The open end of the block 16 thus has identical beveled faces 54. FIG. 4B also shows in dashed lines the location of the beveled horizontal face 50, interlocking vertical recess 32, and a solid inside wall 22 of the transverse wall 25. FIGS. 4C and 4D are front and back isometric views showing the parallel offset walls 20, 22 with the transverse wall 25 and the beveled face 50 on the protrusion 30. The perspective bottom view of FIG. 4E shows the interlocking lower horizontal recess 32, beveled horizontal face 50, and the lower protrusion 30.

Figure 5B:
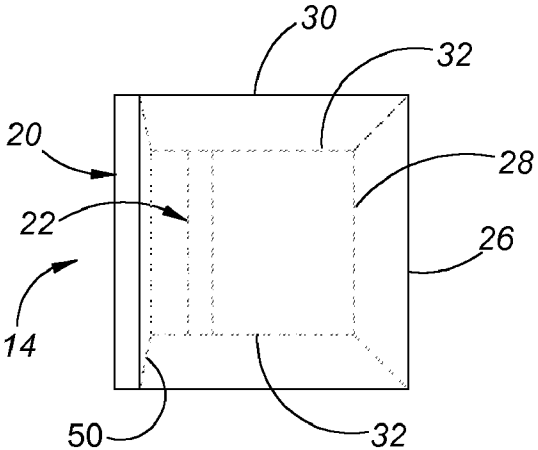
FIGS. 5A-5E are a top view, side view, outside isometric view, inside isometric view, and bottom isometric view, respectively, of a corner block formed in accordance with the present invention.
Figure 5C:
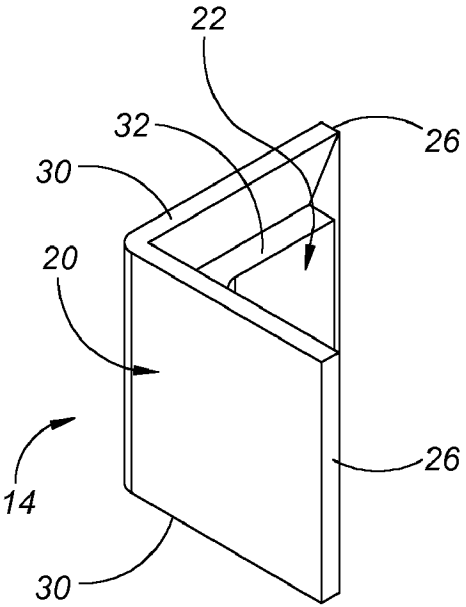
Figure 5A:
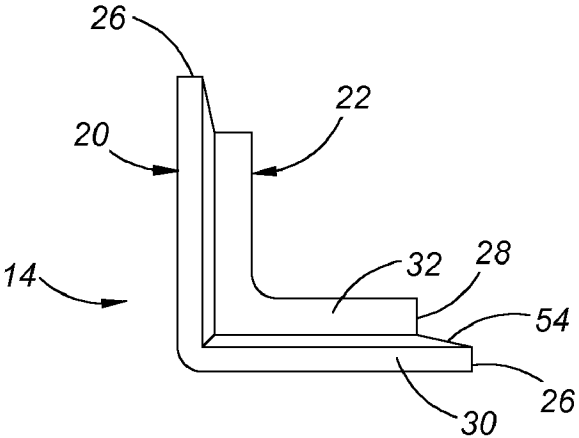
Figure 5E:
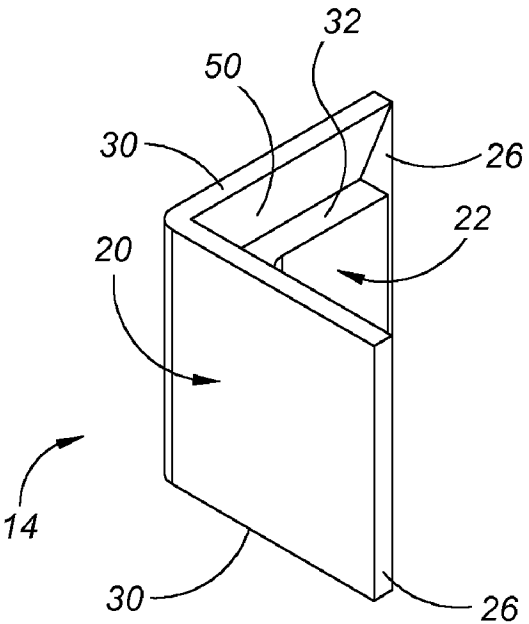
Figure 5D:
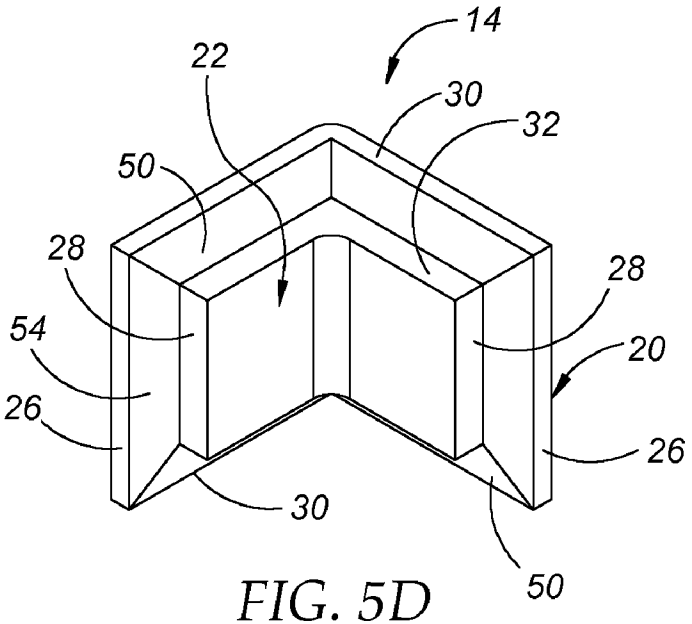

Referring next to FIG. 5A, shown therein is a top view of a corner block 14 having a bookmatched pair of parallel, offset, solid coplanar walls 20, 22 joined to form a right angle. Each end of the outside walls 20 has a longitudinal protrusion 26 with a beveled longitudinal face 54 and a longitudinal recess 28. FIG. 5B is a side view showing with dashed lines the location of a beveled lower horizontal face 50, formed on an inside surface of a vertical protrusion 30 on the outside wall 20, and also showing a vertical recess 32. The offset walls 20, 22 form the interlocking vertical protrusions 30 and corresponding vertical recess 32 as shown in perspective in FIGS. 5C and 5D. The bottom perspective view in FIG. 5E shows the recess 32 in relationship to the lower horizontal beveled face 50.

Operation of the System

FIGS. 1A and 1B show the basic system 8 layout using a plurality of blocks in a single horizontal course and resultant variety of vertical cells formed by various block end configurations when they are aligned in a structural manner. FIG. 6A is an isometric view showing a plurality of blocks when additional horizontal courses are aligned in a structural manner. FIG. 6B shows the resulting repetitive concrete core structure of system 8 after the blocks are filled with concrete. When additional horizontal courses are stacked on top of the first as seen in the end view of FIG. 6C, the two horizontal half-cell cavities 38, one from the bottom side of the block, and the other from the top of the nesting blocks 10, form a single horizontal cell cavity 60, shown as a shaded area in FIG. 6D. Another aspect of the nesting blocks 10 is a vertical butt joint 46. A further aspect is the formation of a horizontal cell 60 and the butt joint 46 is creating surface area within the cavity for grout adherence to bind all the individual units together, as seen in FIG. 6B and 6D. A further aspect of the cell 60 is that when the wall is solidly grouted, a continuous horizontal concrete beam 61 is formed within the wall structure on each and every course as seen in FIGS. 6B and 6D.

The nesting formation shown in FIGS. 6C and 6D and consequential cell formation 60 is also identical to the configuration creating vertical cell 62 formation between successive units in a vertical array viewed from above in FIGS. 6E and 6F when half cells 36 are aligned end to end on of the front and back ends of the runner block 10. Another aspect of the vertically nesting blocks is formation of a longitudinal butt joint 42 as shown in FIG. 6E.

A further aspect of the formation of cell cavity 62 and the butt joint 42 is creating surface area within the cavity for grout adherence to bind all the individual units together, as seen in FIGS. 6E and 6F. A further aspect of the cell 62 is that when the wall is solidly grouted, a continuous vertical concrete beam 63 is formed within the wall structure on each and every course as seen in the FIGS. 6B and 6F. The end view of FIG. 6C of a typical multiple course wall section shows the series of combined horizontal half cells 38 to form single grout cells 60. The dashed lines lead to the equivalent modulus in FIG. 6D when the same blocks are filled with concrete grout as shown by the shaded lines.

Another aspect of the cell cavity 60 is to provide a continuous channel for lateral reinforcement bar 58 or other utility conduits, which rest on the transverse member 24. When multiple horizontal courses are stacked vertically, as shown in the end view of FIG. 6D with a consistent staggered half block relationship, the horizontal courses shown in FIG. 6D viewed from above retains a consistent minimum modular vertical grout cell cavity 62 that repeats itself in a vertical plane as seen in FIG. 6F when the same stack of blocks in FIG. 6D are viewed from above. The dashed lines between FIG. 6E and 6D show alignment modulus of multiple stacked units and resulting minimum wall cavities. Another aspect of the cell 62 is it provides space for the vertical reinforcement bar 56 or other utility conduit.

When the cavity wall in FIG. 6A is grouted, the resultant concrete becomes a single interlocking mass as seen in FIG. 6B. FIG. 6A also shows suggested placement of horizontal 58 and vertical 56 reinforcement bars within the cavity wall. A further aspect of the cells 60, 62 is becoming part of the monolithic grout mass.

Installation

The block system 8 is intended to be simple and to require no special masonry skills in installation; however, careful attention must be given to a variety of considerations:

a) Proper layout, where from end to end on any first horizontal course it is ideal to have the wall length an even multiple of the basic runner 10.

b) A perfectly flat concrete footing so the individual units will align easily without modification. Although a certain tolerance is inherent in the system and adjustments can be made, installation is more efficient when starting from an even surface.

c) Careful positioning in the concrete foundation of vertical reinforcing bars 56 as seen in FIG. 6A to stay in line with the vertical grout columns 62.

d) Use of a minimum amount of adhesive with high shear strength between vertical butt joints 46 to help insure alignment and stability while grouting. Adhesive is not intended to be a structural element in itself.

e) Taking reasonable precautions during grouting and staging pours to keep hydrostatic pressure low, especially on highly flowable grout mixes such as cellular concrete.

All other aspects of installation are comparable with other types of cmus. Either chalked or scribed lines are placed on a fresh concrete footing to delineate the various wall formations. A first course is laid out to check for accuracy parallel to actual wall, then a thin bed of adhesive applied to the concrete, or none at all if the concrete is still fresh and bondable. The first course is then set, after which subsequent courses can be stacked. Courses are laid up similar to other block systems, whereby the corners are built up vertically as leads, then followed by the horizontal courses in between which can be set either visually or with the aid of a string line as is the custom. As there is no mortar to place, an installation can proceed very quickly.

Method of Manufacturing

The preferred manufacturing method would be wet casting concrete using either individual molds or battery cast with multiple molds. Another method could be using modified conventional hydraulic dry press concrete block equipment. Another method could be a modified extrusion type process whereby a section plane is extruded horizontally on a conveyored supportive membrane with supportive sidewalls, and the corresponding vertical cellular structures are formed using vertical displacement plungers while the concrete is still plastic. Another method could be with injection molded concrete in heated molds or other accelerated cure treatment.

Accordingly, numerous advantages will be appreciated from the foregoing system 8, which is simple in form and application, yet stronger structurally. Although the above description of the invention has many preferred embodiments, it should be understood that various changes, adaptations, and modifications may be made. For example, the height of all units in this block system are of a uniform nature relative to their width. One variation would be having a block height equal to one half the width, while retaining all other relationships. It may utilize, if necessary, a different or novel methodology of manufacture. Thus, the invention is not limited to the details illustrated, and the scope should be determined by the appended claims and their legal equivalents, rather than solely by the examples given.

All U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

The invention claimed is:

1. A structural block for use with a system of structured blocks, the structural block comprising: at least two walls, each wall comprising a pair of walls formed of an inside wall and an outside wall, the outside wall extending beyond the inside wall to have a greater length and height than the inside wall, which forms protrusions on the ends and the top and bottom of the at least two walls, each protrusion having a circumscribing flat edge face of sufficient width to form a butt joint with other structural blocks in which the circumscribing flat face is the only point of contact with other structural blocks abutting the flat face, each wall having an identical configuration to the other of the at least two walls, and the block is formed from concrete.

2. The block of claim 1 wherein the block comprises only two walls, the two walls joined together at an end of each of the two walls and at a right angle to form a corner block having only two walls.

3. The block of claim 1 wherein the at least two walls are joined together by at least one transverse member and wherein the inside wall has beveled faces adjacent the outside wall.

4. A mortarless structural block system, comprising: at least two blocks formed of concrete, each block comprising: at least two sidewalls, each sidewall comprising a pair of walls formed of an inside wall and an outside wall, the outside walls forming a protrusion on the ends and top and bottom of each outside wall that extend a length and a height of the outside wall that is greater than a length and height of the inside wall, and further forming at least one recess that cooperate with the protrusion and at least one recess of an abutting block to form at least one cavity, each protrusion having a circumscribing flat edge face of sufficient width to form a butt joint with flat edge faces of other adjacent structural blocks that is the only point of contact with the other adjacent structural blocks, each sidewall having an identical configuration to the other of the at least two sidewalls.

5. The system of claim 4 wherein the pair of sidewalls are joined together by at least one transverse member having identical top and bottom surfaces.

6. The system of claim 5 wherein when the at least two blocks are placed together, the transverse members and the sidewalls of the adjacent blocks form at least one horizontal and vertical cavity.

7. The system of claim 6 wherein the at least one horizontal and vertical cavity is filled with grout material.

8. The system of claim comprising interlocking features defined by grout spaces contiguous to all blocks.

9. An interlocking mortarless structural concrete block building system, comprising:

a plurality of runner blocks formed of concrete and placed in abutting relationship to each other without mortar between the runner blocks, each runner block comprising a pair of sidewalls, each sidewall comprising an outside wall portion and an inside wall portion dimensioned smaller than the outside wall portion such that the outside wall portion extends beyond the inside wall portion to have a greater length and a greater height than the inside wall portion and to thereby form protrusions that extend the length and the height of the outside wall portion, each protrusion having a circumscribing flat face orthogonal to an outside face of the outside wall portion, and the inside wall portion forming recesses, each sidewall having an identical configuration to the other of the at least two sidewalls, each runner block placed in abutting relationship with other runner blocks so that the flat faces on the adjacent protrusions bear against one another in full contact to provide a butt joint with frictional stability, and the protrusions and recesses of adjacent abutting runner blocks form first internal cavities, and at least one transverse member extending to each inside wall and cooperating with the at least one transverse member of adjacent runner blocks to form second internal cavities that communicate with the first internal cavities;

at least one of an end block and a corner block having protrusions with flat edge faces placed in abutting relationship with at least one of the plurality of runner blocks; and a fill material in the first and second internal cavities of each block to interlock the blocks together.

10. The system of claim 9 wherein the plurality of runner blocks are stacked in successive horizontal courses in staggered relationship.

11. The system of claim 9 wherein each runner block further comprises a beveled face formed between each protrusion and each recess.

12. The system of claim 11 wherein each beveled face is formed on an interior face of each protrusion, and the beveled faces cooperate with the protrusions and recesses to form a cellular structure that comprises the internal cavities.

13. The system of claim 12 wherein each runner block comprises two transverse members forming a single cell between them and a half cell on another side of each transverse member, each transverse member having identical top and bottom surfaces.

14. The system of claim 9 wherein the corner block comprises only two sidewalls joined together at a right angle at an end of each sidewall.

15. The system of claim 4, comprising at least one corner block, each at least one corner block comprising only two sidewalls joined together at an end of each sidewall to form a right angle between the two sidewalls.

16. The block of claim 3 wherein a space between the at least two walls of the block comprises a cell having a length that is ¾ a length of the block, and the block has a width that is ¾ the length of the block.

17. The system of claim 5 wherein each block comprises a space between the at least two sidewalls and between two transverse members that define a cell having a length that is ¾ a length of the block.

18. The system of claim 17, wherein the at least two blocks define a vertical cell when stacked on top of each other, the vertical cell defined by a space that is formed between the at least two sidewalls of the at least two blocks and that is between the transverse members of the at least two blocks, the vertical cell having a minimum vertical dimension that is at least ¼ the block length.

* * * * *

UNITED STATES PATENT AND TRADEMARK OFFICE

CERTIFICATE OF CORRECTION

PATENT NO. : 7,905,070 B2
APPLICATION NO. : 11/611767
DATED : March 15, 2011
INVENTOR(S) : John August It is certified that error appears in the above-identified patent and that said Letters Patent is hereby corrected as shown below:

Column 10, Line 51:
"8. The system of claim comprising interlocking features" should read, --8. The system of claim 4 comprising interlocking features--.

Signed and Sealed this
Twenty-seventh Day of September, 2011

David J. Kappos
*Director of the United States Patent and Trademark Office*